US010845175B2

(12) United States Patent
Tobón Trujillo

(10) Patent No.: US 10,845,175 B2
(45) Date of Patent: Nov. 24, 2020

(54) ELECTROMECHANICAL CONTACT FUSE FOR MULTIPURPOSE AIRCRAFT AMMUNITION

(71) Applicant: Luis Eduardo Tobón Trujillo, Medellín, CO (US)

(72) Inventor: Luis Eduardo Tobón Trujillo, Medellín, CO (US)

( * ) Notice: Subject to any disclaimer, the term of this patent is extended or adjusted under 35 U.S.C. 154(b) by 0 days.

(21) Appl. No.: 16/479,194

(22) PCT Filed: Aug. 14, 2018

(86) PCT No.: PCT/IB2018/056107
§ 371 (c)(1),
(2) Date: Jul. 18, 2019

(87) PCT Pub. No.: WO2019/034995
PCT Pub. Date: Feb. 21, 2019

(65) Prior Publication Data

US 2019/0360791 A1 Nov. 28, 2019

(30) Foreign Application Priority Data

Aug. 17, 2017 (CO) ..... 2017/0008406

(51) Int. Cl.
*F42C 15/40* (2006.01)
*F42C 1/09* (2006.01)
*F42C 9/04* (2006.01)

(52) U.S. Cl.
CPC ..... *F42C 15/40* (2013.01); *F42C 1/09* (2013.01); *F42C 9/041* (2013.01)

(58) Field of Classification Search
CPC ..... F42C 9/041; F42C 9/043; F42C 9/045; F42C 9/147; F42C 11/002; F42C 11/01;
(Continued)

(56) References Cited

U.S. PATENT DOCUMENTS 3,434,424 A 3/1969 Lohninger
3,802,343 A 4/1974 Dahl
(Continued)

FOREIGN PATENT DOCUMENTS

CN 105371713 A 3/2016
DE 2626136 A1 12/1973
(Continued)

OTHER PUBLICATIONS

Mipro—A Swedish Fuze Supplier, Mipro-s Product field. [online], Dec. 3, 2013, [retrieved on Oct. 10, 2018]. retrieved from <http://www.miprotech.se/ products. htm>.
(Continued)

*Primary Examiner* — Stephen Johnson
(74) *Attorney, Agent, or Firm* — Mariana I. Vernieri

(57) ABSTRACT

The present invention relates to the military field. It discloses a contact fuse for multi-purpose aircraft ammunition, characterised in that it comprises an electromechanical arming system that is easy to manufacture and does not contain any explosive material inside of same. In addition, said fuse is characterised in that it comprises an alert system that reveals a possibly unsafe condition on the ground and in that it is structurally straightforward to manufacture.

4 Claims, 5 Drawing Sheets

(58) Field of Classification Search
CPC ..... F42C 11/06; F42C 11/065; F42C 15/40; F42C 15/20
See application file for complete search history.

(56) References Cited

U.S. PATENT DOCUMENTS

| | | | | | |
|---|---|---|---|---|---|
| 3,805,703 | A | | 4/1974 | Cummings | |
| 3,839,963 | A | | 10/1974 | Nathan et al. | |
| 3,857,338 | A | | 12/1974 | Bucklisch | |
| 3,877,378 | A | * | 4/1975 | Clark | F42C 9/148 102/207 |
| 3,967,556 | A | | 7/1976 | Post | |
| 3,973,501 | A | | 8/1976 | Briggs | |
| 3,994,231 | A | | 11/1976 | Rudeen | |
| 4,212,246 | A | | 7/1980 | Eaton | |
| 4,215,630 | A | | 8/1980 | Hagelberg et al. | |
| 4,309,946 | A | | 1/1982 | Block | |
| 4,372,212 | A | | 2/1983 | Hoelzen | |
| 4,380,197 | A | | 4/1983 | Eaton | |
| 4,727,810 | A | | 3/1988 | Furst et al. | |
| 4,836,107 | A | | 6/1989 | Lang et al. | |
| 5,016,532 | A | | 5/1991 | Edminster | |
| 5,271,327 | A | | 12/1993 | Filo | |
| 5,585,592 | A | | 12/1996 | Stearns | |
| 5,594,195 | A | * | 1/1997 | Lenko | F42C 15/20 102/207 |
| 6,314,887 | B1 | | 11/2001 | Robinson | |
| 8,342,093 | B2 | | 1/2013 | Westphal | |
| 2006/0042494 | A1 | | 3/2006 | Lucas et al. | |

FOREIGN PATENT DOCUMENTS

| | | | | | |
|---|---|---|---|---|---|
| DE | 2310668 | A1 | | 9/1974 | |
| DE | 7308205 | U | | 4/1977 | |
| DE | 3311620 | A1 | | 11/1984 | |
| DE | 3414688 | A1 | | 7/1987 | |
| DE | 3936807 | C1 | | 12/1990 | |
| DE | 102013017331 | A1 | | 4/2015 | |
| DK | 2342531 | T3 | | 5/2015 | |
| EP | 0247227 | A1 | | 12/1987 | |
| FR | 2510250 | A1 | * | 1/1983 | F42C 11/003 |
| FR | 2522405 | A1 | | 9/1983 | |
| FR | 2214105 | A1 | | 5/1984 | |
| GB | 1133740 | A | | 11/1968 | |
| GB | 1375691 | A | | 11/1974 | |
| GB | 1389359 | A | | 4/1975 | |
| GB | 1389360 | A | | 4/1975 | |
| GB | 1581919 | A | | 12/1980 | |
| GB | 2159931 | A | | 2/1988 | |
| WO | WO8000610 | A1 | | 4/1980 | |
| WO | WO2019102259 | A1 | | 5/2019 | |

OTHER PUBLICATIONS

Nasser, A. et al. Recent Advancements in Proximity Fuzes Technology. International Journal of Engineering Research & Technology (IJERT), 2015, vol. 4, p. 1233-1238 DOI: 10.17577/IJERTV4IS041400.

* cited by examiner

ELECTROMECHANICAL CONTACT FUSE FOR MULTIPURPOSE AIRCRAFT AMMUNITION

TECHNICAL FIELD

The present invention relates to the military field, more specifically to the field of ammunition fuzes. Particularly, the disclosure refers to a percussion fuze and, more specifically, to a percussion fuze having an electromechanical arming system and an alert system in case an accidental alignment occurs.

BACKGROUND OF THE INVENTION

It is well known that many countries have suffered public order problems due to terrorism throughout history. The combat with terrorist groups has increased the need to acquire war material that allows defending the population and national territory. In developing countries, such as Colombia, war material is traditionally provided by countries with greater technological development at a high cost and with long waiting times, since they have their own safety as a priority.

Currently, in the field of aerial ammunition released by fixed-wing aircraft, fuzes are elements widely used as detonation initiators.

In the military field, a "fuze" refers to a device integrated in a projectile that initiates the detonation of its charge after being fired. Fuzes are used in different types of ammunition in the military field, such as missiles, torpedoes, grenades and aerial bombs.

There are several types of fuzes, such as time fuzes, remote detonators, proximity fuzes and percussion or contact fuzes. In all cases, these fuzes exhibit significant disadvantages since they are expensive, moreover, given that they are not manufactured in developing countries due to their complexity and costs, their acquisition through importation entails waiting times that can get extended and this may pose security issues for the country in need of these devices.

Regarding the types of fuzes, the most known in the state of the art are described below. Time fuzes detonate the load after a period of time set by the user; in this case, the timers can have electronic, mechanical or electromechanical elements. On the other hand, remote detonators use physical connections or radio waves to control and ignite the ammunition. Proximity fuzes cause ammunition to detonate when it comes within a certain preset distance of the target. Conventionally, proximity fuzes utilize sensors, which allow to fix the position of the ammunition with respect to its target. Finally, percussion or contact fuzes refer to fuzes that detonate or activate the detonation reaction once they hit their target.

In the case of percussion or contact fuzes, group to which the fuze of the present invention belongs, the detonation may be instantaneous upon contact with the target or may be preset to occur fractions of time after contact. In artillery usage, ammunition fuzes may be mounted both in the front (nose) and in the back (base or tail) of the ammunition. Percussion fuzes are the most used for being the most affordable option.

Traditionally, percussion fuzes have safety mechanisms for arming to protect users from premature or accidental detonations. It is important to understand that, in military language, specifically speaking of fuzes, a fuze is considered to be armed when a firing stimulus can cause the fuze to work (that makes the ammunition for which it was intended detonate). For the fuze to work, and achieve ignition of the ammunition, for example, of 250 lb (113.4 kg) and 500 lb (226.8 kg) aerial bombs, a component between the ammunition and the fuze, called explosive train, is necessary. The explosive train is the device that starts the ammunition through a small explosion. The explosive element of the train only starts, or detonates, by mechanical percussion provided by the fuze.

Usually, conventional fuzes come with the explosive train inside and have mechanical or electrical safety systems that allow the alignment of the explosive train to the detonation system only when the fuze is armed and ready to detonate the ammunition. Typically, in the state of the art, when the fuze is in safe mode is when the explosive train is misaligned from the firing pin and the detonation system; thus, when a signal is given so that the fuze changes its state and arms itself, the explosive train is aligned to the detonation system leaving the system ready to activate ammunition after contact with the target.

Patent No. DK2342531 discloses a projectile fuze having an explosive train and a physical switch to interrupt the action of the fuze train. The switch is designed to change its status during the change from a safe position to one of activation or unlocking. The invention also has the means for locking the switch in the safe position and for unlocking the switch when the system is to be activated by an unlocking movement.

U.S. Pat. No. 3,994,231 discloses a missile fuze comprising a safety mechanism. In this case, after the launch of the missile, the explosive train of the fuze is aligned electromechanically. As soon as a logical signal is issued for the launch of the detonator, the fuze is powered with energy in order to remove two locking systems composed of solenoids that prevent the alignment of the explosive train. Thus, when the missile is located in close proximity to the target, the fuze is armed.

From the state of the art, it is evident that most of the conventional fuzes come with the explosive train inside, therefore including explosive materials. In this regard, it should be noted that the user's incorrect handling of the mechanism or an inadvertent activation thereof during transport of the ammunition can lead to unintended ignitions that may cause detonations. Therefore, despite the safety mechanisms of conventional percussion fuzes, the fact that they have the explosive train inside poses a latent risk of detonation under the user's inappropriate use or storage.

On the other hand, the safety mechanisms for the fuzes' arming include complex electronic and/or mechanical systems that carry high acquisition costs and greater difficulty for their manufacture. In addition, the fact of having multiple pieces in these systems leads to the manufacture of fuzes with a high weight. This being the case, it is a challenge to develop a fuze with equal or superior effectiveness than the existing ones, and that at the same time involves simplicity in its manufacturing system.

Furthermore, from the state of the art, it can be established that conventional percussion fuzes for aerial ammunition do not have an alert system emitting a visible signal in case of accidental alignment or arming on the ground due to misuse. Typically, the fuzes have a window that allows the technician in charge, on the ground, to visualize the arming status; however, the success of this check depends exclusively on the safety procedure carried out by the technician in charge. In other cases, there is no warning system or way to visualize an improper arming or alignment on the ground.

Accordingly, there is a need in the art for new percussion fuzes that do not include explosive materials inside in order to eliminate the risks associated with accidental detonations. These fuzes must be structurally simple to manufacture in order to reduce costs and enable their production in developing countries. Additionally, it is necessary that the fuzes have an alert system that reveals a possible unsafe condition on the ground by notifying their arming status.

SUMMARY OF THE INVENTION

Therefore, the present invention discloses a percussion fuze for multipurpose aerial ammunition characterized by comprising an electromechanical arming system of simple manufacture that does not include any explosive material inside. In addition, said fuze is characterized by comprising an alert system that reveals a possible unsafe condition on the ground.

The percussion fuze for multipurpose aerial ammunition of the present invention is characterized by not containing explosives inside. Contrarily, the typical percussion fuzes contain the explosive train inside and it is part of the arming system. In some cases, the explosive train multiplier is also part of the internal components. The present invention ensures the safety of the system at all times, since the explosive train and the fuze are separated, and are only assembled once the fuze is to be used.

In the present invention, the explosive train is assembled in an explosive train housing cup located on the outside of the percussion fuze. In turn, the explosive train multiplier is threaded externally in the same housing cup.

Regarding another aspect, the present invention has an electromechanical arming system of simple manufacture that allows the alignment of the fuze's firing pin with the explosive train located in the outer housing cup. In general terms, said electromechanical system comprises a life pin that is released once the aircraft's arming cable is released. When said pin is removed, the locking system represented by the solenoid is unblocked and the electric circuit is closed to complete the fuze's arming.

Additionally, the percussion fuze for multipurpose aerial ammunition of the present invention is characterized by comprising an alert system including a LED system that alerts in the event of accidental alignment or arming due to improper use or manipulation.

In one aspect of the invention, the present fuze uses electromechanical devices in its interior for its operation and does not include any explosive material inside, making this fuze a safer component than those traditionally used.

In another relevant aspect of the invention, the electromechanical percussion fuze for multipurpose aerial ammunition disclosed herein is characterized by the simplicity of its operation due to the reduced number of internal components compared to traditional fuzes, mostly mechanical in its entirety.

The electromechanical percussion fuze for multipurpose aerial ammunition of the present invention is characterized by being a lightweight device, due to the simplicity of the electromechanical system, totally impermeable, resistant to moisture and salt corrosion, as well as to high temperatures and impacts that may occur during its transportation logistics.

In a further aspect, the electromechanical percussion fuze for multipurpose aerial ammunition of the present invention complies with the provisions of military standard MIL-STD-331C, thus ensuring the safety and functionality of the system under any circumstance within its transport, handling, assembly and use phases.

In another aspect of the invention, the electromechanical percussion fuze for multipurpose aerial ammunition of the present invention can be used in different types of ammunitions in the military field such as, but not limited to, missiles, torpedoes, grenades and aerial bombs.

In another aspect of the invention, the electromechanical percussion fuze for multipurpose aerial ammunition of the present invention can be assembled on the front (nose) of the ammunition.

In another aspect of the invention, the electromechanical percussion fuze for multipurpose aerial ammunition of the present invention can be assembled on the back (tail or base) of the ammunition.

Advantages of the Invention

The advantages of the electromechanical percussion fuze for multipurpose aerial ammunition of the present invention can be summarized based on the following considerations when compared to fuzes of the same type used for similar missions:

The present invention has an internal safety device with a considerably smaller number of elements and with a greater simplicity in its operation, which allows to create a lighter fuze.

Due to the lower number of mechanical elements and the incorporation of the programmed electronic card, there is less probability that the system fails, which at the same time provides the possibility of product maintenance.

The present invention offers the possibility of revealing a possible unsafe ground condition by notifying the arming condition by means of the red LED.

The present invention does not contain explosive elements inside. Its external body allows to assemble both the fire train and its multiplier prior to the flight, which makes the fuze a completely safe component during its logistics transportation.

The electromechanical nature of the device requires a battery change every 10 years, which allows checking and maintenance of the component, extending the life of the system indefinitely.

BRIEF DESCRIPTION OF THE DRAWINGS

With the aim that the present invention can be easily understood and implemented, reference will be made to the attached figures and the description of one or more embodiments of the invention will be detailed.

With reference to the attached figures.

DETAILED DESCRIPTION AND BEST MODE OF IMPLEMENTATION

The following detailed description of the embodiments of the invention refers to the attached figures. Although the description includes exemplary embodiments, other embodiments or changes to the described ones are also possible without departing from the intention and scope of the invention.

Those skilled in the art should appreciate that the configurations disclosed in the following embodiments represent configurations proposed by the inventors for the operation of the invention in practice. However, those skilled in the art should appreciate that many changes can be made in the specific embodiments that are disclosed herein obtaining a result that does not depart from the spirit and scope of the invention.

Figure 1:
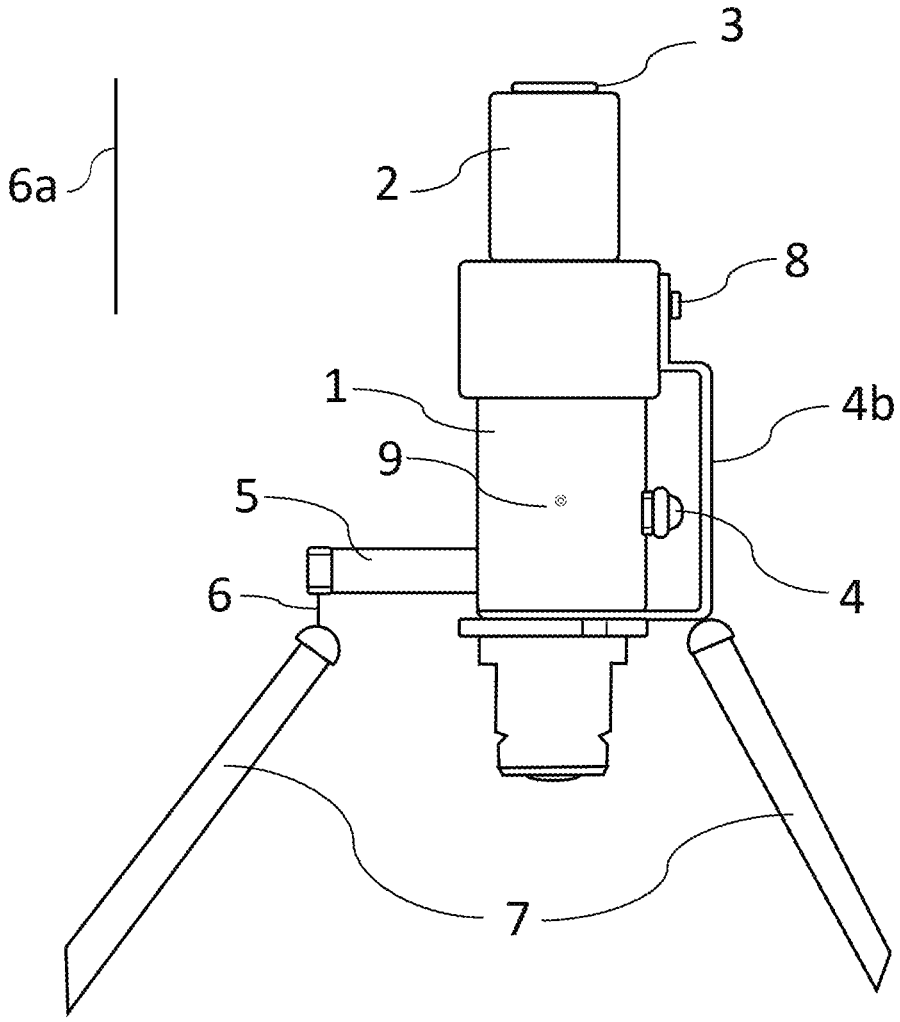
FIG. 1 is a representation of the external front view of the fuze of the invention when the device is locked.

FIG. 1 illustrates the body of the fuze secured as it is seen and handled when it is transported.

As shown in FIG. 1, the present invention includes a housing cup 1 and a front cover 2 that comprise the outer main body of the fuze. These elements are responsible for housing the alarm system as well as the explosive train. Both the front cover 2 and the housing cup 1 are made of aluminum and assembled by threading. The external body is closed with a cap 3 responsible for closing and sealing the front cover 2.

In addition, externally, there is a time setting knob 4 with options "3", "6", "9" and "12". These options represent the time in seconds that must elapse from the release of the ammunition from the aircraft until the start of the arming process. This is known as arming delay time.

For the arming condition to occur, it is necessary that the present invention "knows" when the ammunition has been released by the aircraft; that is, once the weapon is released, a signal must be sent to the fuze for the arming process to initiate. For this purpose, once the bomb has been mounted in the aircraft and the fuze has been assembled in the front (nose) or back (tail) of the ammunition, from the aircraft's rack should be and arming cable passing through any of the housing fitting 5 adjacent to the life pin latch 6 with banderoles 7. The housing fitting 5 is the fuze-aircraft communication path via the arming cable. The life pin latch 6 should only be removed once the fuze is assembled in the ammunition mounted on the aircraft and the arming cable has been previously passed through the housing fitting 5. Banderoles 7 indicate the elements that should be removed just before flying, and that, as a precaution, are secured, as well as the protective case of the time setting knob 4. The protective case 4*b* of the time setting knob 4 is an additional safety method connected to the fuze body by means of the securing screw 8. Additionally, as a preventive safety measure, the housing cup 1 has a red LED 9 (alarm system) that will turn on in case the fuze is in armed condition to notify an unsafe condition due to improper handling and indicate that it should be isolated from the rest.

Figure 2:
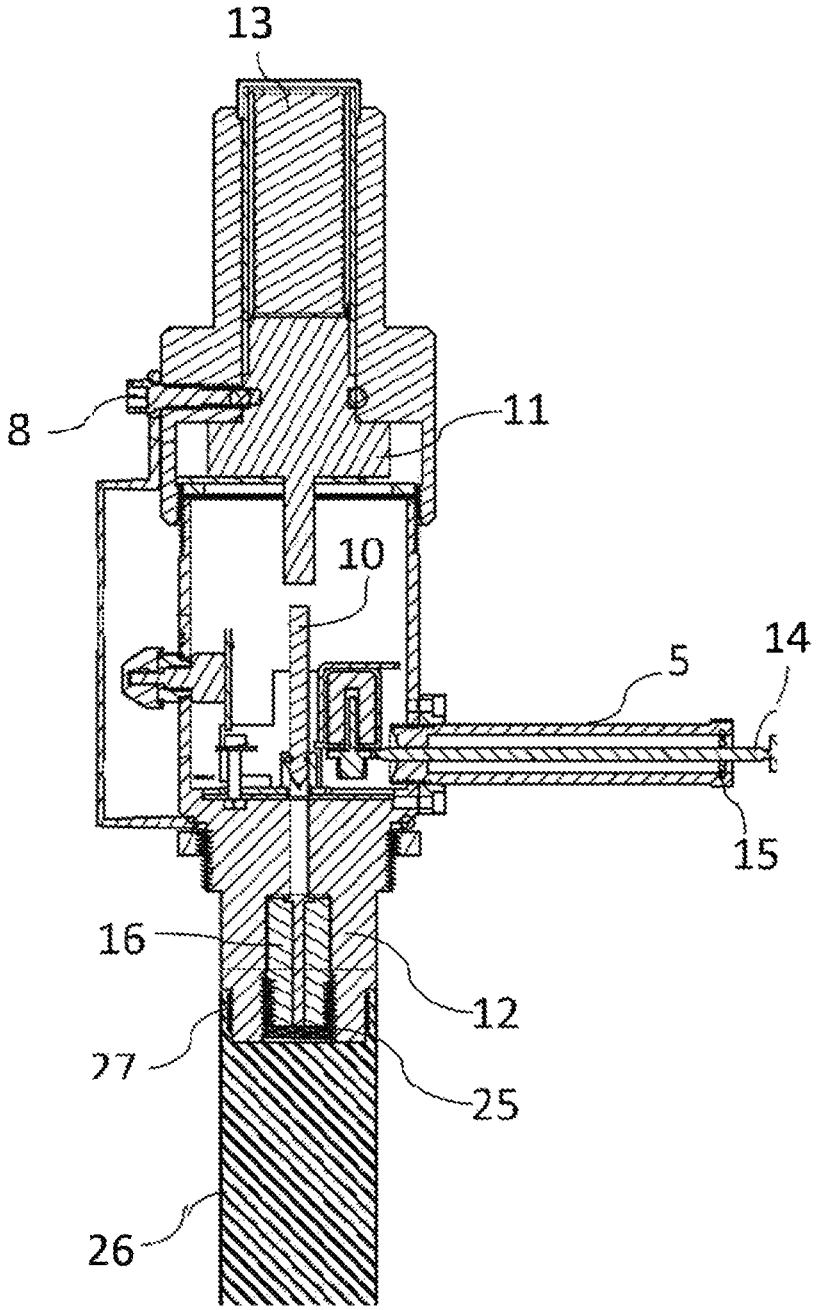
FIG. 2 is a representation of a side cut of the armed fuze of the invention and showing the components of both the arming and alert systems.

FIG. 2 shows a cut-away view of the fuze that allows to see the safety system, which represents the greatest challenge of the present invention. In this figure, the life pin latch 6 (FIG. 1) has already been removed and replaced by the aircraft's arming cable, as well as the securing screw 8 has been removed, leaving the fuze as it should be assembled once the aircraft is to be flown.

FIG. 2 shows the fuze and its safety system in its armed position, which means that the firing pin 10 is aligned with the explosive train housing 12, where the explosive train responsible for detonating and triggering the chain reaction that ignite the ammunition up is threaded.

When the fuze is in its safe or non-armed condition, the firing pin 10 is not aligned with either the impact plunger 11 or the explosive train housing 12. The impact plunger 11 is secured by the securing screw 8. The impact plunger 11, which internally acts as a superior firing pin and is responsible for transmitting the linear movement towards the firing pin 10, once there is contact with the target, it acts as a housing for the power pack or batteries 13 responsible for supplying the necessary power for the internal safety system to work.

Also, FIG. 2 shows the internal contents of the housing fitting 5, of which the life pin 14 and the ejection spring 15 are part. The ejection spring 15 is a pre-loaded helical compression spring locked, on the ground, by the life pin latch 6 (FIG. 1) and, in flight, by the arming cable 6A from the aircraft's rack. Once the arming cable from the aircraft is removed when the ammunition is released, the ejection spring 15 decompresses, releasing the life pin 14 with it. The latter is in charge of closing the circuit that allows the arming of the fuze. The explosive train housing 12 is so configured to allow an explosive train 16 to be internally threaded thereto through threads 25, and to allow an explosive train multiplier 26 to be externally threaded thereto through threads 27.

Figure 3:
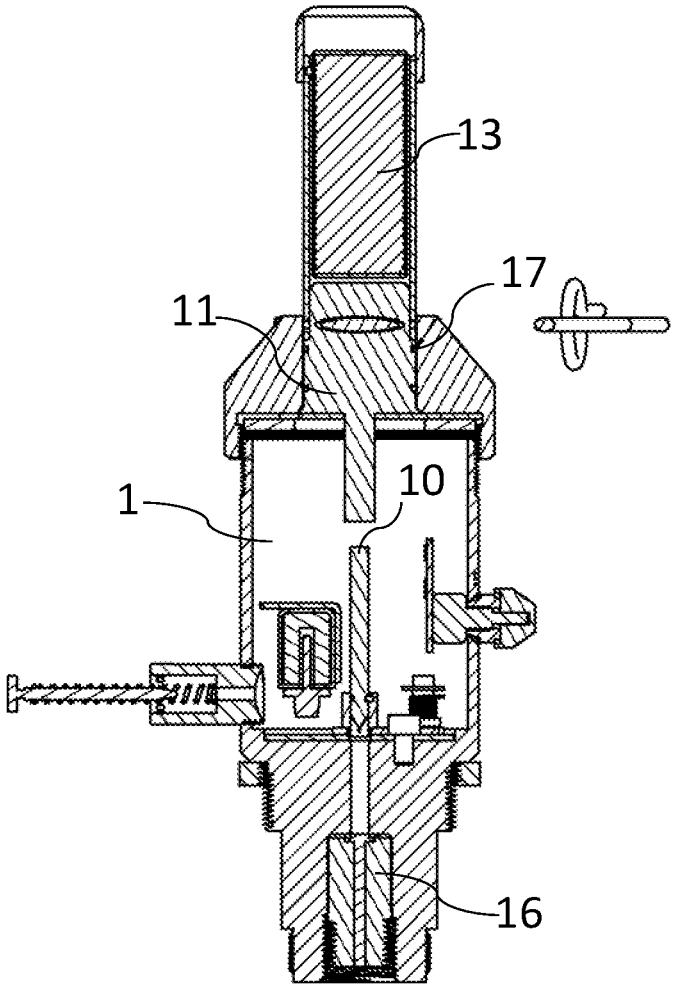
FIG. 3 is a representation of a side cut of the non-armed fuze of the invention and showing the components of both the arming and alert systems.

In FIG. 3 the fuze and its safety system are shown in their unarmed or safe position, which means that the firing pin 10 is not aligned with the explosive train 16 responsible for detonating and triggering the chain reaction that will light the ammunition up. Likewise, the firing pin 10 is also not aligned with the impact plunger 11, which internally acts as a superior firing pin and is responsible for transmitting the linear movement towards the firing pin 10 once there is contact with the target. The impact plunger 11 is fixed in its position so that it does not slide by means of 2 o-rings 17, which are also responsible for preventing the entry of water or humidity into the housing cup 1. Simultaneously, the impact plunger 11 acts as a housing for the power pack or batteries 13 responsible for supplying the necessary power for the internal safety system to work.

Figure 4:
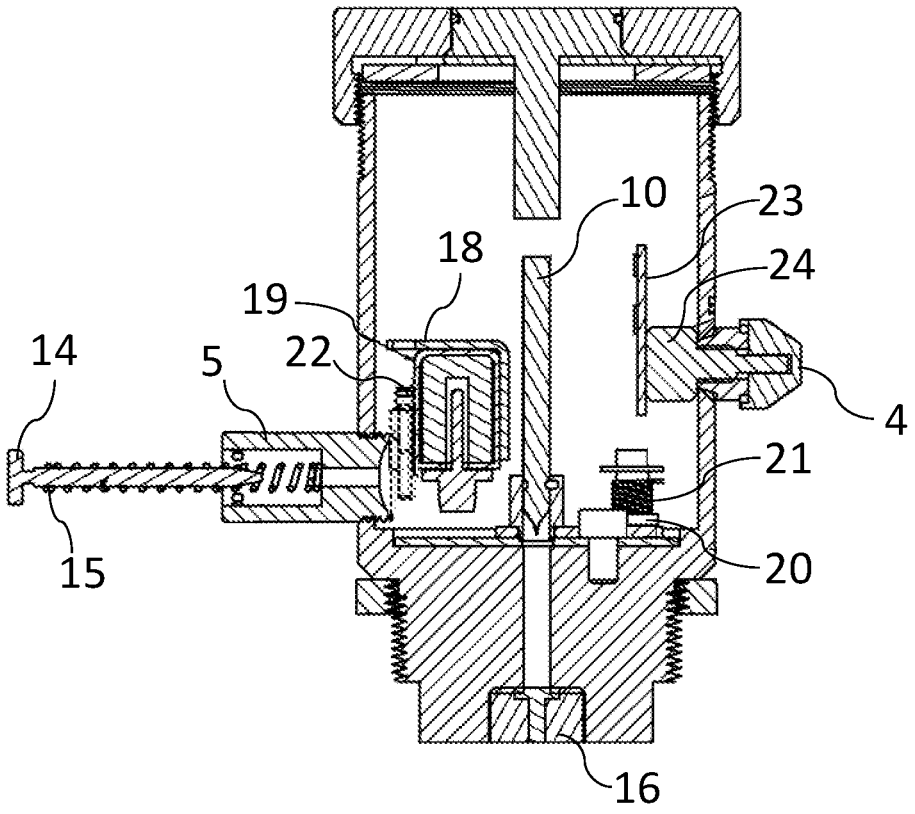
FIG. 4 is a representation of the internal components of the fuze of the invention, particularly the arming system.

FIG. 4 is a zoomed-in image that allows a more detailed view of the main components inside the fuze that are part of the safety system mounted on the chassis 18. In this figure it is possible to see the system in the non-armed position.

From FIG. 4 it is possible to see the fuze with the firing pin 10 out of alignment with respect to the explosive train 16, thus keeping the fuze in the non-armed position. The safety system preventing the alignment of the firing pin 10 consists of a solenoid 19 which locks the cam 20 on which the firing pin 10 is mounted. The cam 20 tends to be mechanically aligned with the explosive train 16 by means of a preloaded torsion helical spring 21. Likewise, the solenoid 19 is mechanically locked by the life pin 14 so that it cannot be retracted. In turn, the life pin 14 keeps the electrical circuit open by obstructing the microswitch 22 responsible for closing the electrical circuit and providing the necessary current for the system to work.

In order for the system to be activated and get to the armed position, it is necessary to release the life pin 14 housed in the housing fitting 5. The life pin 14 enters the housing fitting 5 where the ejection spring 15 is located. The ejection spring is a pre-loaded helical compression spring locked, on the ground, by the life pin latch 6 (FIG. 1) and, in flight, by the arming cable from the aircraft's rack.

Once the ammunition is released in flight and falls by gravity towards the target, the arming cable will remain in the aircraft thus unlocking the preloaded ejection spring 15 and releasing with it the life pin 14. Once the life pin 14 has been released from the housing fitting 5, the microswitch 22 will close, giving continuity to the current coming from the batteries 13 (FIG. 3). The supplied current will go to the electronic card 23 assembled behind the solenoid 19. This is the one responsible for giving the instruction to energize the solenoid 19 after the seconds selected with the time setting knob 4 have elapsed to adjust the arming delay time. The time setting knob 4 sends the signal indicating the arming delay time to the electronic card 23 by means of a selection key 24.

Figure 5:
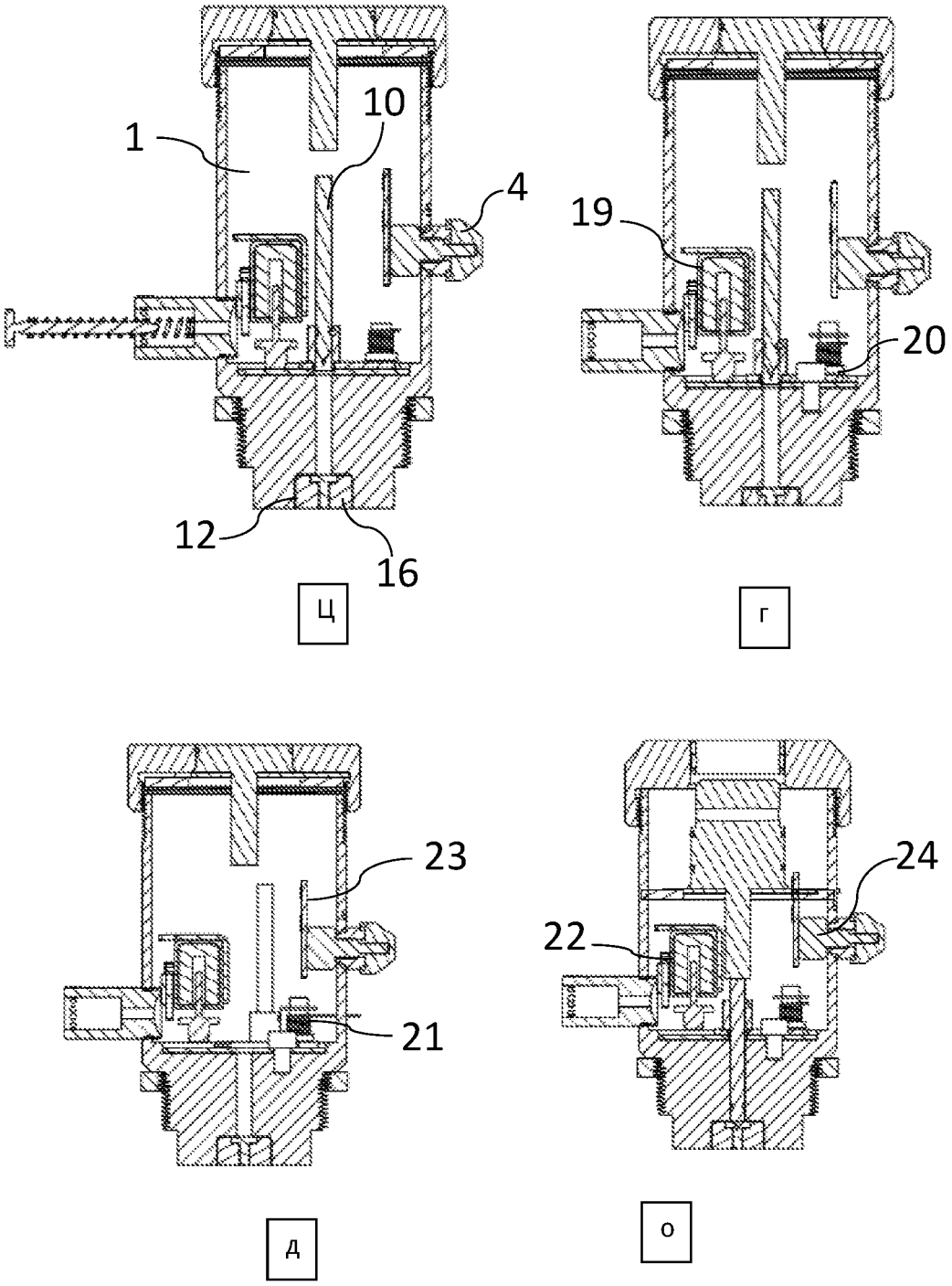
FIG. 5 is a representation of the arming process of the fuze of the present invention.

The images in FIG. 5 are a demonstration of the operating process of the present invention.

Once the pre-selected arming delay time has elapsed on the ground with the time setting knob 4 connected to the selection key 24, the electronic card 23 will energize the solenoid 19 so that it magnetizes and retracts its plunger thus removing the lock that this represents for the cam 20 on which the firing pin 10 is mounted. Once the solenoid 19 removes the lock, the torsion helical spring 21 will release its preload by rotating the cam 20 and leaving the firing pin 10 aligned with the explosive train 16. Once this alignment process is complete, the fuze is considered to be armed. The red LED 9 (FIG. 1) will light up.

In order for the fuze of the present invention to complete its mission, it must perform percussion. For this purpose, once in its armed condition, the ammunition will follow its trajectory in free fall until hitting the surface where the impact plunger 11 will be the first component to make contact with the ground, thus moving and transmitting the movement until hitting the firing pin 10. The firing pin 10 will slide through the machined channel in the housing cup 1 until it impacts and strikes the explosive train 16 threaded in the explosive train housing 12.

Finally, once there is percussion in the explosive train 16, it will detonate initiating an explosive amplifying charge (part of the ammunition or bomb) that will then initiate the final detonation.

The following is claimed:

1. A percussion fuze for multipurpose aerial ammunition comprising:

a. an outer main body comprising a housing cup, a front cover and a cap;

b. an electromechanical arming system comprising an explosive train housing, a solenoid, a life pin, an ejection spring, a firing pin, a housing fitting, an aircraft's arming cable connected to said housing fitting that in a safe position blocks said solenoid which, when blocked, prevents the firing pin's alignment with an explosive train, an electronic card that energizes said solenoid when said solenoid is unblocked by means of removal of said aircraft's arming cable and release of said life pin, in order to align the firing pin with said explosive train; and c. an alert system comprising a LED placed in said housing cup that will send a signal in case the fuze is armed;

wherein:

said explosive train housing is so configured to allow said explosive train to be internally threaded thereto and to allow an explosive train multiplier to be externally threaded to said explosive train housing.

2. The percussion fuze for multipurpose aerial ammunition of claim 1 further comprising a cam, wherein said firing pin is mounted on said cam with a torsion helical spring.

3. The percussion fuze for multipurpose aerial ammunition of claim 1, wherein, said electromechanical arming system further comprises a time setting knob with which a user can set an arming delay time, and said electronic card temporizes the arming delay time set by the user in said time setting knob.

4. The percussion fuze for multipurpose aerial ammunition of any one of the preceding claims, wherein said percussion fuze is assembled at a front and/or back of the ammunition.

* * * * *